United States Patent [19]

Stahl

[11] 4,080,095

[45] Mar. 21, 1978

[54] COOLED TURBINE VANE

[75] Inventor: William F. Stahl, Middletown Township, Delaware County, Pa.

[73] Assignee: Westinghouse Electric Corporation, Pittsburgh, Pa.

[21] Appl. No.: 720,188

[22] Filed: Sep. 2, 1976

[51] Int. Cl.[2] ..... F01D 5/18

[52] U.S. Cl. ..... 415/178; 415/DIG. 1; 416/96 R

[58] Field of Search ..... 415/178, 115, DIG. 1; 416/96 R, 96 A, 97; 165/163, 156

[56] References Cited

FOREIGN PATENT DOCUMENTS

| | | | |
|---|---|---|---|
| 559,309 | 2/1944 | United Kingdom | 165/163 |
| 651,830 | 4/1951 | United Kingdom | 416/96 |
| 728,834 | 4/1955 | United Kingdom | 416/96 |
| 1,222,565 | 2/1971 | United Kingdom | 416/96 |

OTHER PUBLICATIONS

Hodge, R. I. and Johnston, I. H., "A Review of Blade--Cooling Systems," *The Gas Turbine* (Feb., 1958), pp. 396–398.

*Primary Examiner*—Carlton R. Croyle
*Assistant Examiner*—Donald S. Holland
*Attorney, Agent, or Firm*—F. A. Winans

[57] ABSTRACT

A cooled vane for a gas turbine engine in which the coolant channels have an arcuate component, convex outwardly towards the surface of the vane to establish centrifugal force in the coolant flowing therethrough and thereby induce a secondary flow to the coolant, promote mixing and reduce the outer boundary layer of the coolant to enhance the heat transfer characteristics to the coolant and thereby more efficiently maintain the vane within acceptable temperature limitations.

6 Claims, 4 Drawing Figures

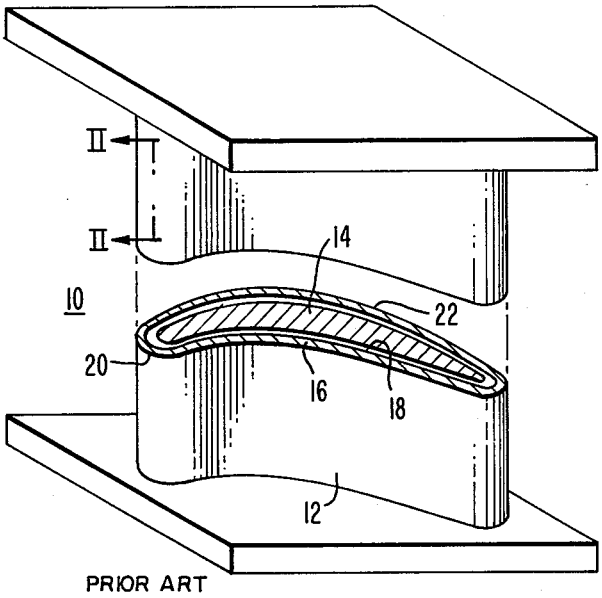
PRIOR ART
FIG.1
FIG.2
PRIOR ART
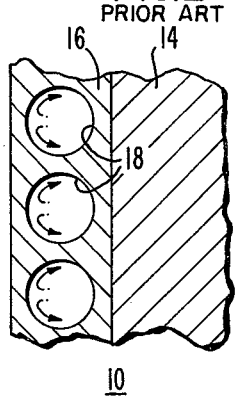
FIG.4
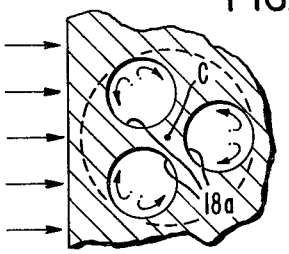
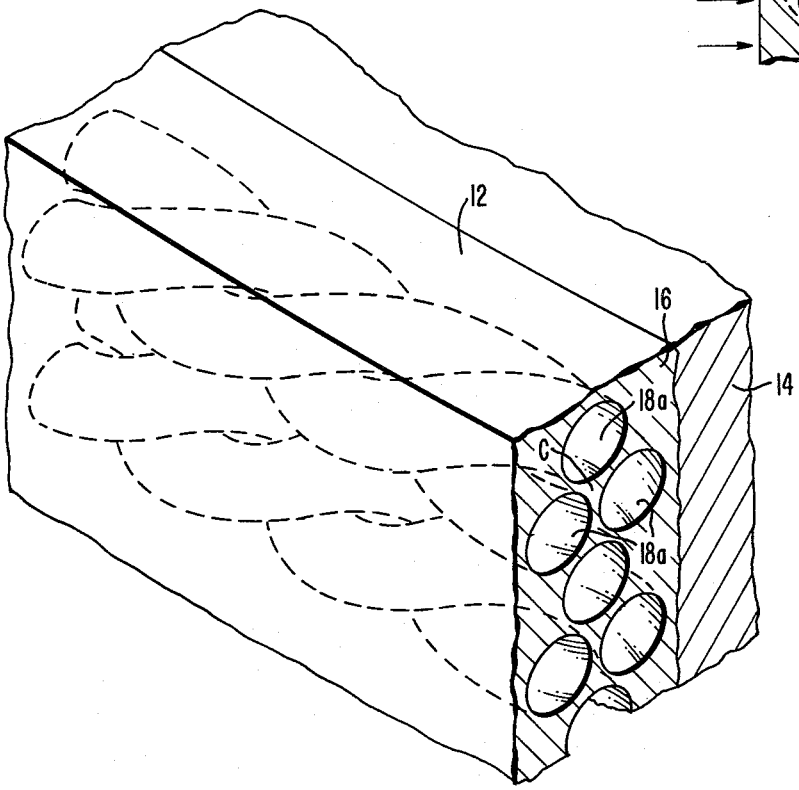
FIG.3

COOLED TURBINE VANE

BACKGROUND OF THE INVENTION

1. Field of the Invention

The present invention relates to water cooled vanes for a gas turbine engine and more particularly to a vane having specifically configured channels adjacent the surface to increase heat transfer between the hot gases impinging upon the vane and the coolant flowing through the channels.

2. Description of the Prior Art

It is well known that the output and thermal efficiency of a gas turbine engine increases as the turbine inlet temperature increases. However, turbine inlet temperature is material limited in that the temperature of the components subjected to the hot gases must retain their physical strength which rapidly decreases at elevated temperatures.

Rather than be limited by such considerations, much work has been done to cool the vanes so that inlet temperatures can be increased over temperatures that would otherwise cause the material to rapidly fail. However, supplying of coolant at velocities sufficient to maintain the desirable temperature within the vane itself generates inefficiencies in the form of pumping losses. Furthermore, for boilable coolants it may be difficult to establish a sufficiently high critical nucleate boiling heat flux.

SUMMARY OF THE INVENTION

This invention describes a cooled vane having a plurality of individual water channels generally adjacent the surface thereof for transporting a coolant such as water therethrough to absorb the heat flux of the motive gases sufficiently rapidly to prevent heat buildup in the vane. According to the present invention, the channels are spiral or twisted in a corkscrew-like configuration to induce an arcuate path to the water flowing therethrough. This arcuate motion of the water produces a centrifugal force which induces a secondary flow in the water as the more rapidly moving central portion of water is urged radially outward in its path by this centrifugal force and thereby reduces the effective thickness of the outer boundary layer and furthermore promotes a mixing of the water, both of these effects enchancing the transfer of heat from the outer channel wall to the water. Thus, more heat is transferred to the coolant within the channels and the vane remains substantially cooler than if the water were passed at an equivalent velocity through channels having uncurved passages.

BRIEF DESCRIPTION OF THE DRAWINGS

FIG. 1 is a schematic view of a cooled vane illustrating a typical coolant flow path of the prior art;

FIG. 2 is a cross-sectional view generally along lines II—II of FIG. 1;

FIG. 3 is a schematic isometric view of the configuration of coolant flow channels in the outer skin of the vane according to the present invention; and, FIG. 4 is a view similar to FIG. 3 with the coolant channels arranged according to the present invention.

DESCRIPION OF THE PREFERRED EMBODIMENT

Referring to FIG. 1 a typical prior art cooled vane 10 is shown which comprises a vane core 14 having an outer skin 16 bonded thereto. The outer skin contains coolant flow channels 18 so that coolant flowing therethrough absorbs heat from the motive gases and transports it away for use or rejection to a cooler part of the turbine in a manner not shown or to a heat sink external to the turbine, also not shown, in order to prevent heat buildup in the vane to a temperature that would ultimately cause destruction of the vane. These flow channels 18 may take paths which are primarily radially directed (not shown) or transverse serpentine directed (also not shown) or simply transverse as shown in FIG. 1 which is illustrative of a typical vane coolant flow configuration. It is also seen that a typical vane 10 includes a concave pressure surface 12, a rounded nose portion 20, and a convex suction surface 22.

It is also well known that a fluid flowing through a channel produces a boundary layer adjacent the channel walls, with the depth or thickness of the boundary layer generally dependent upon the velocity of the fluid therethrough. However, when using an internal flowing fluid as a cooling medium, the boundary layer impedes the heat flux into the flowing fluid. Thus, by decreasing the thickness of the boundary layer, the heat removal or absorption rate of the internal flowing fluid can be increased.

It is further known that a fluid in a channel with a circular or arcuate path establishes a secondary fluid flow; centrifugal force acting more strongly on the higher velocity central portion of the fluid than on the slower moving fluids in the boundary layer causes the central fluid to move radially outward in its path toward the outer wall as depicted by the arrows in FIG. 2 which, being the arc of the nose portion 20 of the vane 10, has a leftwardly directed centrifugal force on the fluid flowing in the cooling passages 18. This secondary flow combines with the thru-stream flow to promote mixing and to generally reduce the boundary layer thickness and thus enhance the transfer of heat from the blade to the fluid, particularly for the pathwise radially outer portion of the channel.

The arcuate path of the coolant passages 18 traversing the convex side 22 of the vane 10 and traversing the nose portion 20 as shown in FIG. 1, inherently provides a centrifugal force to the coolant that establishes the secondary flow and reduces the boundary layer adjacent the surface of the vane so that heat transfer thereinto from the exterior is enhanced. However, on the concave or pressure side 12, it is noted that the curvature of the vane 10 is directly opposite, such that, with a coolant path as depicted in FIG. 1, an increased boundary layer is established in the channel on the side adjacent the surface which thus impedes the heat transfer to the coolant fluid.

The present invention provides a flow path configuration for the coolant on the concave pressure surface 12 of the vane 10 that establishes a centrifugal force such that a secondary flow is established, mixing is promoted, the boundary layer of the coolant adjacent the outer surface of the vane is reduced and the transfer of heat from the vane surface to the coolant fluid is enhanced.

Thus, referring to FIGS. 3 and 4, it is seen that the coolant passage **18*a* in the outer skin on at least the concave surface of the vane according to the present invention is spirally or helically configured, or, when grouped together such as in groups of three, are twisted about a common center C. Thus, the helically transversely extending coolant flow path 18*a* generates an arcuate motion to the coolant (shown by the circle shown in phantom) that develops a centrifugal force which acts against that portion of the channel fluid radially outward of the projected or effective center to establish the secondary flow and to reduce the boundary layer of the coolant adjacent the radially outermost area or wall of the flow path as shown by the arrows in FIG. 4** for increased exposure or mixing of the coolant to flow to that surface.

As seen in FIG. 4, the channel surface having the least boundary layer is generally adjacent the outer surface of the vane and is thus able to more efficiently absorb the heat flux (depicted as arrows) of the gases striking this area of the vane through greater heat transfer capability and secondary flow established at this area and thereby maintains the temperature of the vane within acceptable temperature limitations more efficiently.

I claim:

1. A gas turbine vane having an external surface exposed to hot motive gases and having a coolant flow path formed within the vane adjacent said surface and wherein:

at least some portion of said flow path includes a plurality of separate helically-extending passages to impart a circular motion to coolant flowing therethrough resulting in a secondary flow direction and a reduced boundary layer in said coolant to increase heat transfer thereto from said surface and wherein said plurality of said helically extending passages are at a common radius and about a common center of the helix defined thereby.

2. Structure according to claim 1 wherein said surface of said vane includes a concave pressure surface and wherein said portion of said flow path defining said plurality of helically extending passages is adjacent said pressure surface.

3. A gas turbine vane having an external surface exposed to hot motive gases and having a coolant flow path formed within the vane adjacent said surface and wherein:

said flow path includes a plurality of helically extending portions establishing a centrifugal force in coolant flowing therethrough thereby inducing a secondary flow in said coolant and reducing the boundary layer of said coolant generally adjacent said surface to increase heat transfer from said vane to said coolant and wherein said plurality of helically extending portions are separated into groups of two or more such portions with each said portion in each group having a common center and at a common radius with any other helically extending portion of the same group.

4. Structure according to claim 3 wherein said surface of said vane includes a concave pressure surface and wherein said helically extending portions are disposed adjacent said pressure surface.

5. Structure according to claim 4 wherein said helically extending flow paths are provided to substantially traverse the complete suction surface.

6. A cooled vane for a gas turbine engine having a plurality of individual coolant flow channels formed therein generally adjacent the surface of said vane, each individual channel extending in a helical configuration providing an arcuate path for inducing centrifugal force in the coolant flowing therethrough and wherein a plurality of said individual helically extending channels are grouped together about a common center for each helix, and wherein a plurality of said groups generally traverse the surface to be cooled by the coolant therein.

* * * * *